US008550930B1

(12) United States Patent
Medin, III

(10) Patent No.: US 8,550,930 B1
(45) Date of Patent: Oct. 8, 2013

(54) RELATIVE HIP MOTION ATHLETIC TRAINING DEVICE AND METHOD

(76) Inventor: John T. Medin, III, Escondido, CA (US)

( * ) Notice: Subject to any disclaimer, the term of this patent is extended or adjusted under 35 U.S.C. 154(b) by 0 days.

(21) Appl. No.: 13/370,248

(22) Filed: Feb. 9, 2012

Related U.S. Application Data

(60) Provisional application No. 61/440,968, filed on Feb. 9, 2011.

(51) Int. Cl.
*A63B 69/36* (2006.01)

(52) U.S. Cl.
USPC ..... 473/215; 473/212

(58) Field of Classification Search
USPC ..... 473/207, 215, 266, 269, 276, 277, 409
See application file for complete search history.

(56) References Cited

U.S. PATENT DOCUMENTS

| | | | | |
|---|---|---|---|---|
| 2,093,153 | A * | 9/1937 | McCarthy | 473/212 |
| 4,895,373 | A * | 1/1990 | Richmon | 473/215 |
| 6,095,936 | A * | 8/2000 | Kirkpatrick et al. | 473/450 |

* cited by examiner

*Primary Examiner* — Nini Legesse
(74) *Attorney, Agent, or Firm* — Charmasson, Buchaca & Leach, LLP

(57) ABSTRACT

A sport training device wearable by a human user, includes an oblong resilient, flexible member diagonally connecting one side of a shoulder harness to the opposite side of a separate hip harness. The member is tensioned in the user's upright, untwisted standing position. During a swing or a baseball-type pitching action, as the user's hips properly rotate with respect to the user's shoulders, the tension reduces thus encouraging and indicating to the user the preferred relative hip rotation action. Adjustments are provided adjust the length and tension of the resilient member. A member which deflects uniformly under a compressive load can be used as a measuring device of the relative angle between the hip and shoulder.

9 Claims, 10 Drawing Sheets

RELATIVE HIP MOTION ATHLETIC TRAINING DEVICE AND METHOD

PRIOR APPLICATION

This application claims the benefit of U.S. Provisional Patent Application Ser. No. 61/440,968 filed Feb. 9, 2011 which is incorporated herein by reference.

FIELD OF THE INVENTION

This invention relates to sports training aids and more particularly to devices and methods used to produce the same swinging or thrown ball velocity with less arm strain, and consequentially a lower incidence of arm injury.

BACKGROUND

Many sports involve a throwing or swinging motion such as the throwing of a ball (baseball, etc.) or swinging of a bat (baseball, softball, etc.) club (golf, etc.) or racquet (tennis, racquetball, etc.). The arm providing the power to the motion is known as the power arm in swinging or the throwing arm in throwing. In this specification the power arm will be referred to as the throwing arm regardless of whether the person is throwing or swinging. The person's other, non-power arm is known as the non-throwing arm. Each arm is associated with its respective shoulder so that there is a throwing shoulder and a non-throwing shoulder. Further, the hip on the same side of the body as the throwing arm can be referred to as the throwing side hip or simply throwing hip. The hip on the opposite side of the throwing arm can be referred to as the non-throwing side hip or simply the non-throwing hip.

Improper throwing or swinging motions can strain a person's arm and shoulder and potentially lead to injury. Maximizing the effectiveness and efficiency of the correct throwing motion can result in similar velocities as incorrect throwing, but with lower effort and less strain, and in so doing reduce stress on the arm muscles, tendons, ligaments and other structures thereby reducing the incidence of arm injuries.

Proper throwing or swinging mechanics typically require hip rotation with respect to the shoulders. The amount of hip motion can vary. Determining whether an adequate amount of hip motion has occurred during a given throw or swing for a given individual can be difficult.

This invention results from an attempt to devise a simple and more efficient method and apparatus to improve sports ball throwing and swinging velocity and reduce arm injuries caused by incorrect mechanics.

SUMMARY

The principal and secondary objects of the invention are to provide an improved training aid.

These and other objects are achieved by relative hip motion training device and method.

In some embodiments there is provided a training aid, also known as a sport training device, to engender the correct human hip rotation causing the correct "core" torsion to most effectively and efficiently transfer energy to a ball through throw or swing. In some embodiments this can maximize velocity through the most efficient and effective energy transfer.

In some embodiments a measurement capability is added to a Hip Rotation Visual Indicator and focus on the use of the device to help train the correct batting swing. Subsequent devices will be provided for golf (club swing) football (throwing football) tennis (racquet swing, etc.)

Some embodiments provide clear visual evidence and cues of correct (rear) hip rotation in relation to the opposite (front) shoulder. Some embodiments provide clear evidence and visual cues that hip rotation is either minimal, moderate or maximal in relation to the opposite shoulder.

In some embodiments there is provided a sport training device wearable by a human user, said device comprises: a shoulder harness; a hip harness; an oblong resilient, flexible member having an uncompressed and untensioned linear first length, and opposite first and second ends; said first end being attached to a first location on said shoulder harness; said second end being attached to a first position on said hip harness; said first location being proximal to a first non-throwing one of said user's shoulders; said first position being proximal to a first one of said user's hips; wherein said first one of said user's hips is on an opposite side of the body than said first non-throwing one of said user's shoulders; wherein said first length is selected so that said member is resiliently extended under tension when said users hips are parallel with said users shoulders; and, wherein said first length is selected so that said member is unextended when said user's hips and shoulders are angularly separated away from parallel by a first non-zero angle.

In some embodiments the device further comprises: an oblong, substantially non-resilient, flexible back strap having an uncompressed and untensioned linear second length, and opposite first and second terminuses; said first terminus being attached to a second location on said shoulder harness; said second terminus being attached to a second position on said hip harness; said second location being proximal to said first non-throwing one of said user's shoulders; and, said second position being proximal to said first one of said user's hips on an opposite side of the user's body from said non-throwing shoulder.

In some embodiments said first location is adjustable.

In some embodiments said first position is adjustable.

In some embodiments said member deflects uniformly under a compression load.

In some embodiments the unextended condition of said member is measurable as an indicator of said angle.

In some embodiments said member comprises an amount of material selected from the group consisting of surgical tubing and shock cord.

In some embodiments said member comprises a tension coil spring wherein the windings contact one another while the spring is at rest.

In some embodiments the device further comprises a projection of a substantially horizontal plane of motion of said shoulders onto a substantially horizontal plane of motion of said hips.

In some embodiments there is provided a method for training a user in an arm swinging sport, said method comprises: fitting a shoulder harness and a hip harness onto a user; attaching a first oblong resilient member between a non-throwing shoulder of said user and an opposite, throwing side hip of said user; and, adjusting said member so that it provides a tensioning load to said harnesses when said user's shoulders and hips are substantially parallel, and provides a no tensioning load when said user's hips are twisted beyond a first angle with respect to said shoulders.

In some embodiments said attaching a first oblong resilient member comprises running said first oblong resilient member diagonally across the front of the user's torso.

In some embodiments the method further comprises attaching a second oblong non-resilient member between a non-throwing shoulder of said user and an opposite, throwing side hip of said user diagonally across said user's back.

In some embodiments the method further comprises initiating in said user an arm swinging sporting motion using said throwing arm.

The content of the original claims is incorporated herein by reference as summarizing features in one or more exemplary embodiments.

DESCRIPTION OF THE EXEMPLARY EMBODIMENTS

Figure 1:
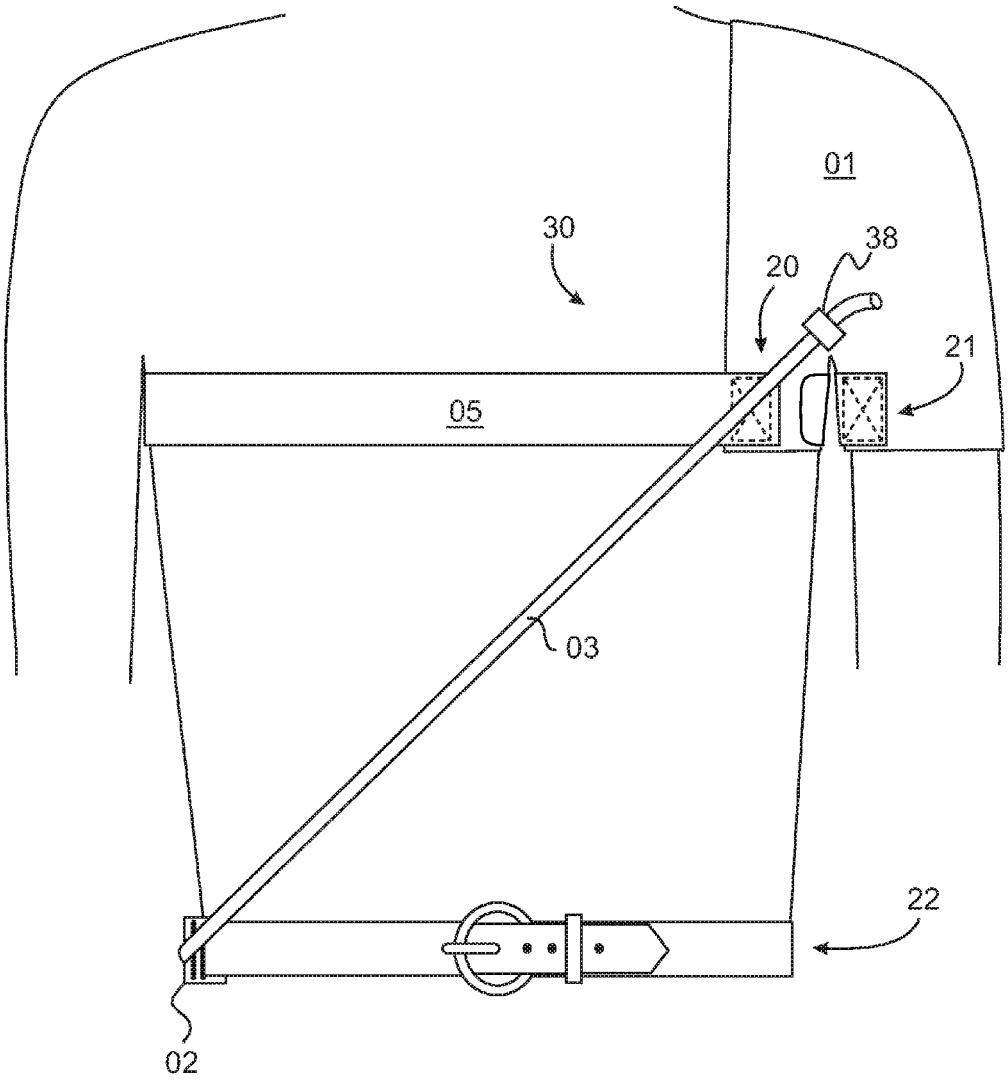
FIG. 1 is a diagrammatic front view of the training device harnesses and resilient member according to the invention as worn by a user.

Referring now to the drawing, there is shown in FIGS. 1-13 a relative hip motion athletic training device and method. The instant exemplary embodiment provides feedback to the user during and after an arm swinging sporting motion such as the ball throwing motion or bat swinging motion in baseball. The feedback indicates to the user whether proper throwing or swinging mechanics are present by detecting the amount of hip motion relative to the shoulders by tracking the motion of the hip on the same side as the throwing arm with respect to the opposite non-throwing shoulder.

The primary components of the device are a non-throwing shoulder cap 01, an opposite hip belt anchor 02, a hip rotation visual indicator 03, a back strap 04, an optional chest strap 05, and an arm strap 06.

Shoulder Cap

A shoulder harness 30 is provided which is worn by the user and secures to the user's shoulder to provide an attachment point at a first location proximal to the user's non-throwing shoulder. The harness includes a shoulder cap 01 whose primary function is to be the non-throwing or front shoulder reference point for the correct hip rotation and anchor point for the back strap 04, arm strap 06 and latch for the hip rotation visual indicator 03. Thus the shoulder cap acts as one of the two major anchor components for the device.

The cap is preferably made from a flexible, durable, moderately resilient, fabric sheet material such as neoprene which can stretch to aid the forming of close conformance to the variability's of the human shoulder. Other possible materials such as vinyl or leather can be used but may not be as adaptable to multiple users of the device.

Preferably, the cap can be made from two commensurately shaped and dimensioned identical patterns of fabric sewn together with industrial strength thread along only the top to outside arm arc to form a substantially cup shape which is shaped and dimensioned closely nest the shoulder in order to provide proper stability of the device. By using two identically shaped pieces, manufacturing costs can be reduced. When properly engaged upon a user's shoulder, one piece covers the front of the shoulder and the other covers the back. The shoulder cap extends laterally from the outside of the shoulder onto the torso near the arm toward the neck. The lateral distance is about one third of the distance across the lateral span between the shoulders. The shoulder cap extends a distance downwardly from the top of the shoulder to a point beyond the crook of the underarm. Its length from the top of where the underside of the arm connects to the chest is to be long enough to allow the proper affixing of the optional chest strap 05 and arm strap 06.

Figure 2:
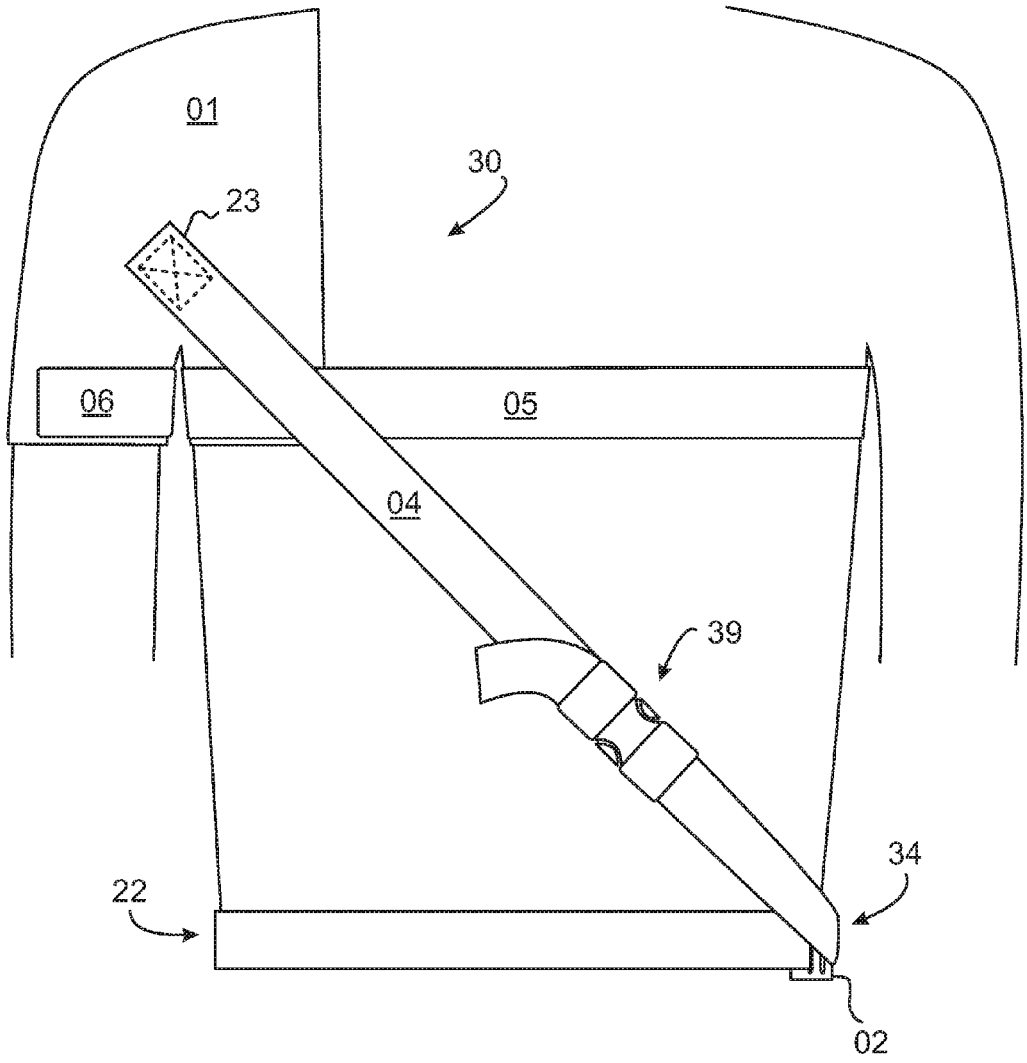
FIG. 2 is a diagrammatic back view thereof.

The shoulder cap 01 provides anchorments for some of the other components of the device. One terminus 23 of the back strap 04 is affixed to the back shoulder cap piece using the traditional box, or box and "x" sewing pattern as indicated in FIG. 2.

Similarly, the optional chest strap 05 can be affixed at a first end to the front shoulder cap piece using the traditional box, or box and "x" sewing pattern as indicated in FIG. 1. An opposite second end of the chest strap 05 can be adjustably affixed to the front shoulder cap piece by use of a latch structure 20 so that the chest strap fit snugly and securely to the user. The latch structure can be formed using cooperative patches of VELCRO brand hook-and-loop fabric fastener (hereinafter "Velcro") since it provides for continuously incremental positioning.

A first end of the arm strap 06 can also be affixed to the front piece of the shoulder cap 01 using a box, or box and "x" sewing pattern as indicated in FIG. 1. An opposite second end of the arm strap 06 can be adjustably affixed to the back shoulder cap piece by use of a latch structure 21 so that the chest strap fit snugly and securely to the user. The latch structure can be formed using cooperative patches of VELCRO brand hook-and-loop fabric fastener (hereinafter "Velcro") since it provides for continuously incremental positioning.

Opposite Hip Belt Anchor

A hip harness 22 is provided which is worn by the user and secures to the user's hip to provide an attachment point at a first position proximal to one of the user's hips on the opposite side from the shoulder attachment location. The hip harness includes an opposite hip belt anchor 02.

The primary function of the opposite hip belt anchor is to be the hip reference point for proper hip rotation by acting as an anchor point for the hip rotation visual indicator 03 and to act as an anchor point for the back strap 04. Thus the opposite hip belt anchor acts as one of the two major anchor components for the device.

The preferred material for the hip harness is a durable, flexible, semi-rigid fabric sheet material such as leather or vinyl. To reduce costs the material can be the same that is used for the shoulder cap 01. For added durability and stiffness the material can be doubled and sewn together.

Figure 3:
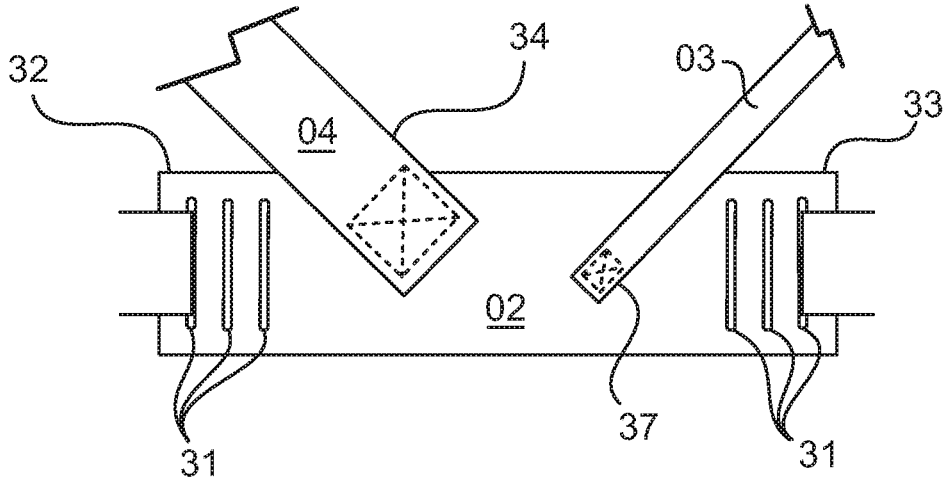
FIG. 3 is a diagrammatic side view thereof showing the adjustable hip attachment portion.

The hip harness is constructed to have multiple belt slots 31 on both ends 32,33 to accommodate the different belt loop placements in the different brands of baseball pants. In this way the hip harness can formed by the combination of the opposite hip belt anchor and the user's own clothing belt. Other means for securing the opposite hip belt anchor to the hip can be used such as a Velcro patch on the back side of the anchor and a corresponding patch on the user's pants, or other means well known in the art. Thus, the hip harness can consist only of the anchor and its means for attachment. One terminus 34 of the back strap 04 is affixed to the opposite hip belt anchor 02 using a traditional box, or box and "x" sewing pattern as indicated in FIG. 3. One end 37 of the hip rotation visual indicator 03 is affixed to the opposite hip belt anchor 02 using the traditional box, or box and "x" sewing pattern as indicated in FIG. 3.

Hip Rotation Visual Indicator

An oblong resiliently flexible member 03 is provided having a first end 37 for securing to the hip harness 22 and an opposite end 38 for attaching to the shoulder harness 30. The member has an uncompressed and untensioned linear first length which can be stretched under a load commensurate with a change in distance experienced between a user's shoulder and opposite hip during a proper sports arm swinging motion and standing upright in an untwisted stance. Thus the member's resiliency and length are selected so that the member is under tension when the users hips are parallel with the users shoulders.

The primary function of the member is to act as the primary means to indicate proper hip rotation and to potentially measure the angle to which the hips have moved relative to the user's shoulders. The member can be referred to as a hip rotation visual indicator 03.

The member can be made using a range from low cost materials and simple visual indicators, or higher cost materials for comfort, adjustability, durability and precision of measurement to facilitate baselining and measurement of progress.

Thus the member can be made using a length of elastic tubular material such as surgical tubing, or shock cord (also known as "Bungee" cord) as shown in FIG. 1. This material is inexpensive but may not provide a precise measurement of proper hip rotation.

Figure 4:
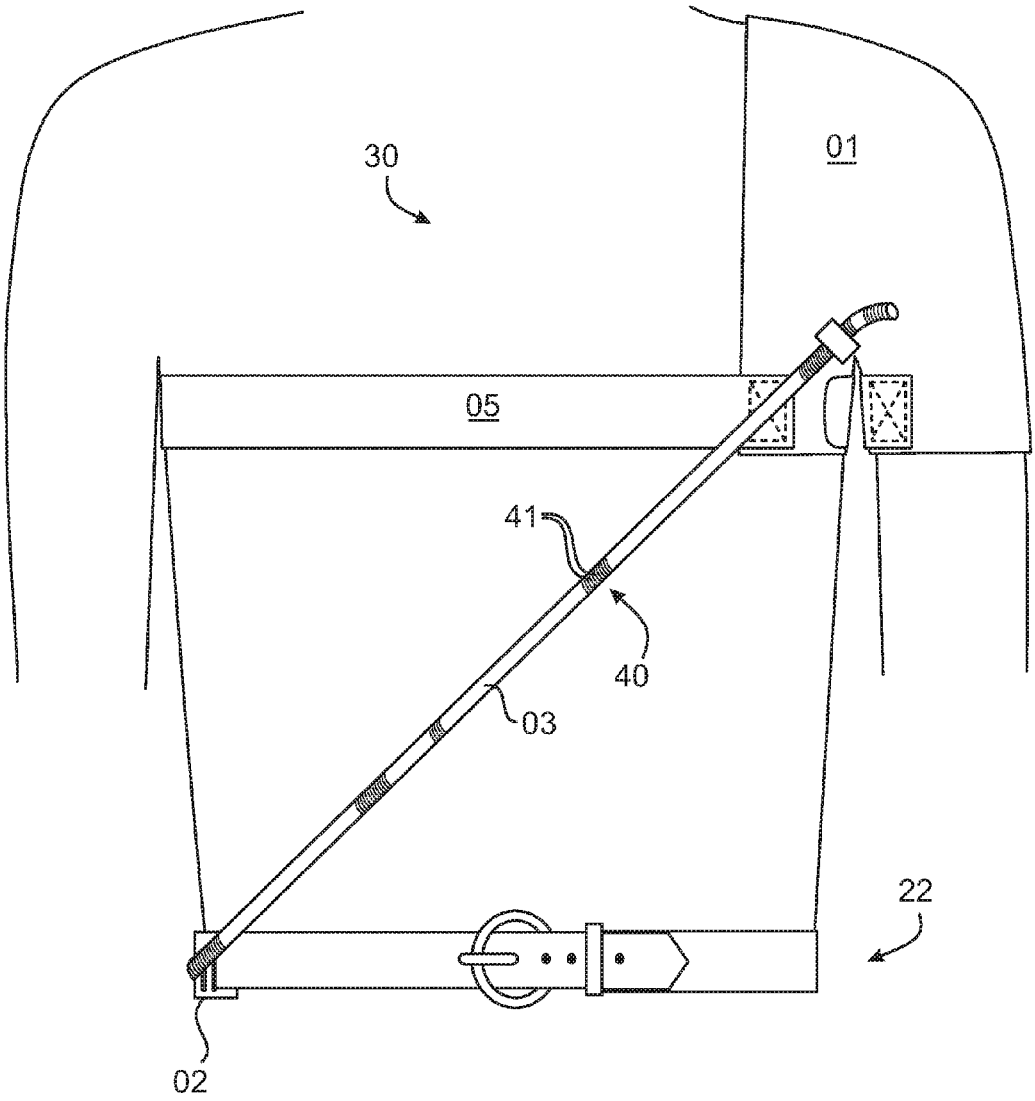
FIG. 4 is a diagrammatic front view of the training device harnesses and a first alternate resilient member.

Optionally, for greater precision of measurement, a more costly spring-type material can be used such as a length of tension coil spring 40 wherein adjacent windings 41 contact one another while the spring is at rest as shown in FIG. 4. This material can provide a consistent deformation or bowing deflection when the member is placed under a compression load which provides a better indicator of proper hip rotation and to what extent.

Figure 5:
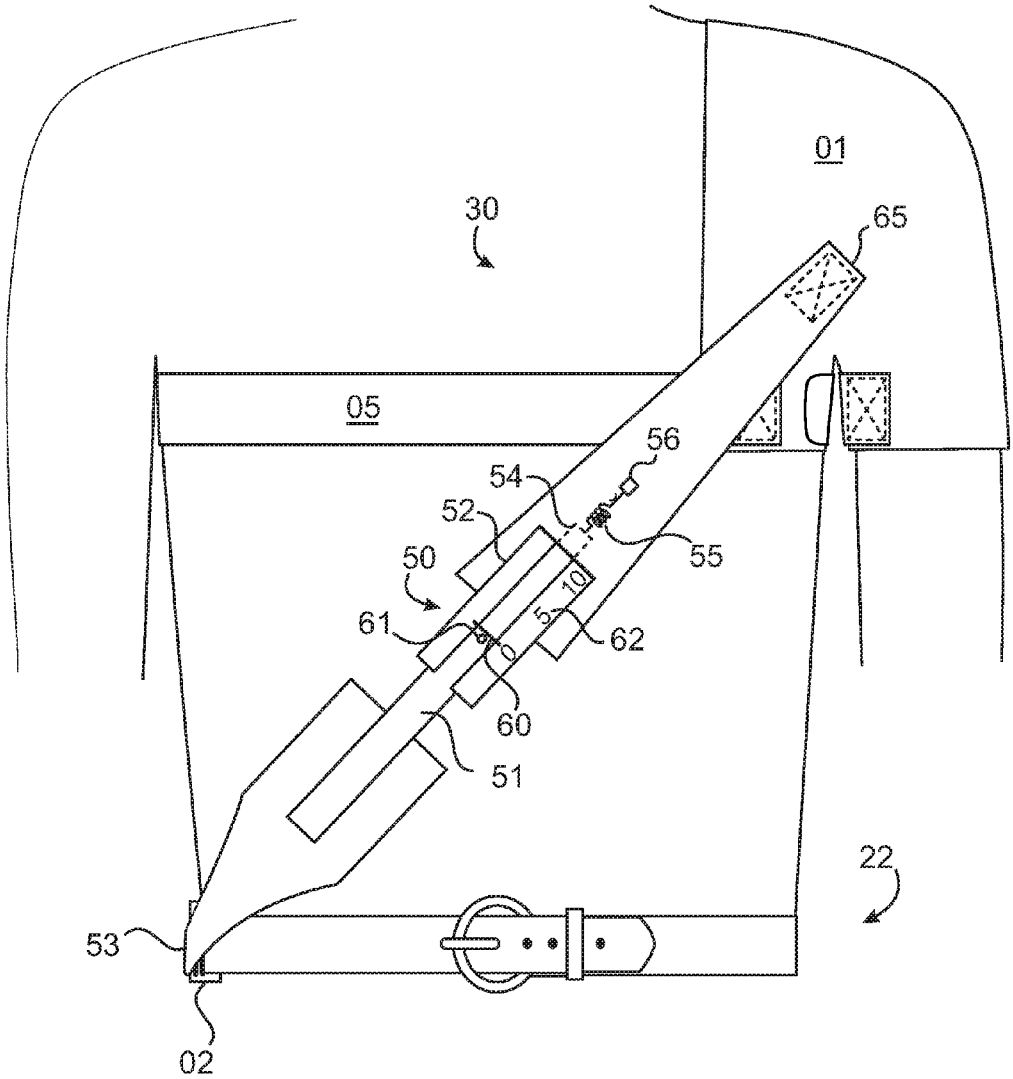
FIG. 5 is a diagrammatic front view of the training device harnesses and a second alternate resilient member.

Optionally, for even greater precision of measurement, a more costly sliding measurement indicator 50 can be provided as depicted in FIG. 5 which includes a two part belt where a first part 51 slides longitudinally with respect to a second part 52. The first part 51 has a first end 53 attached to the hip harness 22 and an opposite end 54 slidingly secured to the second part 52. A spring 55 biases the end 54 toward an adjustable attachment point 56 located on the second belt part 52. A sliding indicator band 60 is driven to slide toward the shoulder during a pitching motion by a bump 61 located on the belt first part 51. The friction between the band 60 and the belt second part 52 is selected to cause the band to remain at its maximum driven extent during the pitching motion. The location of the band on the second belt part can be measured by a scale 62 imprinted on the belt second part. In other words, as the user returns to a standing orientation where the shoulders and hips are parallel, the belt first part moves toward the hip while the belt second part does not. Thus, the bump recedes from the band leaving it in place as a measurement of just how far the bump proceeded toward the shoulder.

This embodiment is capable of measuring both an initial baseline and continued progress as user iterates proper hip rotation practice over time. Unlike the earlier embodiments which measure proper hip rotation in relation to the shoulders by the deformation (bowing or slackening) of the hip rotation visual indicator, this embodiment instead uses two substantially rigid and overlapping belt material pieces to connect the shoulder cap 01 to the opposite hip belt anchor 02 using the sliding measurement device between these two pieces. As the hip rotates properly in relation to the opposite shoulder the distance between the two pieces necessarily shortens. This causes the lower belt piece first part of the sliding measurement device to slide up further into the upper belt piece second part. This in turn pushes the measurement band up further into the upper part thus allowing for measurement of the extent of proper hip rotation.

Lastly, in an even more costly embodiment, sensors and electronics can be encased in protective holders located in two locations: 1) where the latch would normally be attached for the hip rotation visual indicator on the shoulder cap 01 for option 1; and, 2) where the hip rotation visual indicator would normally be attached to the opposite hip belt anchor 02 for option 1. The sensors are designed such that the proximity, angles and changes in both enable the measurement of baselines and iterative improvement of the correct (rear) hip rotation in relation to the opposite (front) shoulder.

Figure 13:
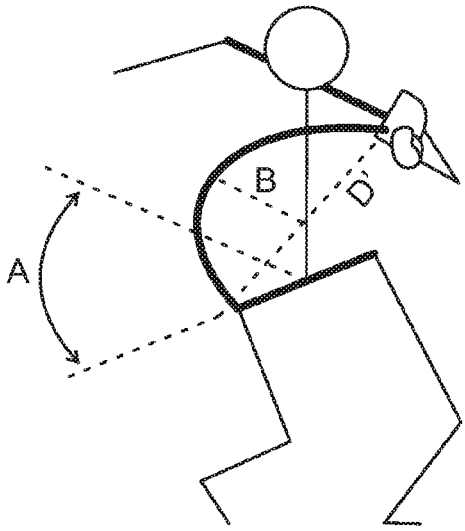

This even more costly embodiment provides for highly precise measurements of initial capability (baseline) and continued progress as user iterates proper hip rotation practice over time in an easy to use fashion. It also accommodates a greater variety of human body types (i.e. users with large or protruding stomachs.) In addition it also allows for precise measurement (including precise angle measurement) of the rear hip rotation in relation to the opposite (front) shoulder. This angle is depicted in FIG. 13 and denoted as A. Unlike the prior embodiments described above, this embodiment does not rely on mechanical means but on electronics, particularly electronic sensors, to measure baselining and iterative progress improvement.

Thus, the hip rotation visual indicator 03 is shaped and dimensioned to have a first end 37 which can be affixed to the opposite hip belt anchor 02 using the traditional box, or box and "x" sewing pattern as indicated in FIG. 3 or be adjustably affixed using corresponding Velcro patches. The hip rotation visual indicator 03 is further shaped and dimensioned to have a second end 38 which can be affixed to the shoulder cap 01 above where the underside of the arm connects to the chest as indicated in FIG. 1, or be adjustably affixed using corresponding Velcro patches 65, so as to accommodate difference in body dimensions.

Back Strap

The primary function of the back strap 04 is to provide extra stability to both the shoulder cap 01 and opposite hip belt anchor 02. Secondarily, the back strap acts as an area for signage such as brand messaging, product name or website location.

The back strap 04 is preferably made from an oblong, flexible, durable, substantially non-resilient, fabric strap material such as polypropylene weave, nylon weave, or leather. The term "substantially non-resilient" is used because of the material's flexibility in which there may be some minimal amount of stretching.

The back strap 04 is shaped and dimensioned to have an uncompressed and untensioned linear second length to provide a first terminus 23 affixed to the back of the shoulder cap 01 using the traditional box, or box and "x" sewing pattern as indicated in FIG. 2, and a second opposite terminus 34 is affixed to the opposite hip belt anchor 02 using the traditional box, or box and "x" sewing pattern as indicated in FIG. 3. The length of the back strap can be adjusted by using a latching mechanism 39 which also allows for loosening, tightening and fine adjustment. A quick releasing, snap together latching mechanism commonly called a "side release buckle" can be used to allow for quick removal while retaining a selected length, or a "Tri-Glide" type buckle can be used.

Optional Chest Strap

An optional chest strap can be used to provide additional stability for the shoulder cap 01 and provide an additional convenient location for signage such as brand messaging.

The optional chest strap is made from a durable, flexible, medium weight, medium stretch material such as neoprene.

The optional chest strap is shaped and dimensioned to be affixed to the front shoulder piece using the traditional box, or box and "x" sewing pattern as indicated in FIG. 1. After being stretched across front of the chest, it is stretched around the back before being latched to the front shoulder piece. The preferred approach is the use of Velcro for its incremental positioning latching properties.

Arm Strap

An adjustable arm strap 06 is used to provide additional stability for shoulder cap 01 by wrapping around the underside of the user's non-throwing arm between the front and back pieces of the shoulder cap 01. The arm strap is preferably made from a strip of durable, flexible, substantially non-resilient sheet material such as leather or vinyl. The arm strap 06 is affixed at a first end to the front piece of the shoulder using a traditional box, or box and "x" sewing pattern as indicated in FIG. 1. The arm strap stretches around inside of upper arm and is adjustably affixed to back piece of the shoulder cap using cooperative patches of Velcro to provide a comfortable and secure fit. Indeed, the entire strap can be made from a piece of Velcro material of the first type such as the "loop" type oriented to bond against a patch of Velcro material of the second type formed onto the outside surface of the front piece of the shoulder cap.

How to Put on

Since the Opposite Hip Belt Anchor requires a belt, and the Hip Rotation Visual Indicator works best with no clothing interference, the best clothing to wear are baseball pants and a close fitting shirt such as the popular stretch fit performance tops.

1. Thread the baseball pant belt through slots on both ends of the Opposite Hip Belt Anchor such that it sits on the hip of the throwing arm side. Be careful to thread the belt through properly so that the belt does not interfere with the either the Back Strap or the Hip Rotation Visual Indicator.
2. Fit the shoulder cap 01 over the non-throwing arm shoulder.
3. Tighten the back strap 04 by adjusting the buckle 39.
4. Stretch the arm strap 06 around inside of the non-throwing arm and secure using the Velcro fastener so that arm strap fits snugly.
5. If the optional chest strap 05 is used, it is run across chest, around the back and secured using the Velcro fastener so that the chest strap fits snugly around the chest.
6. Finally, latch the hip rotation visual indicator 03 to the shoulder cap 01 making sure there is no slack but not so tight that it is stretched.

Figure 6:
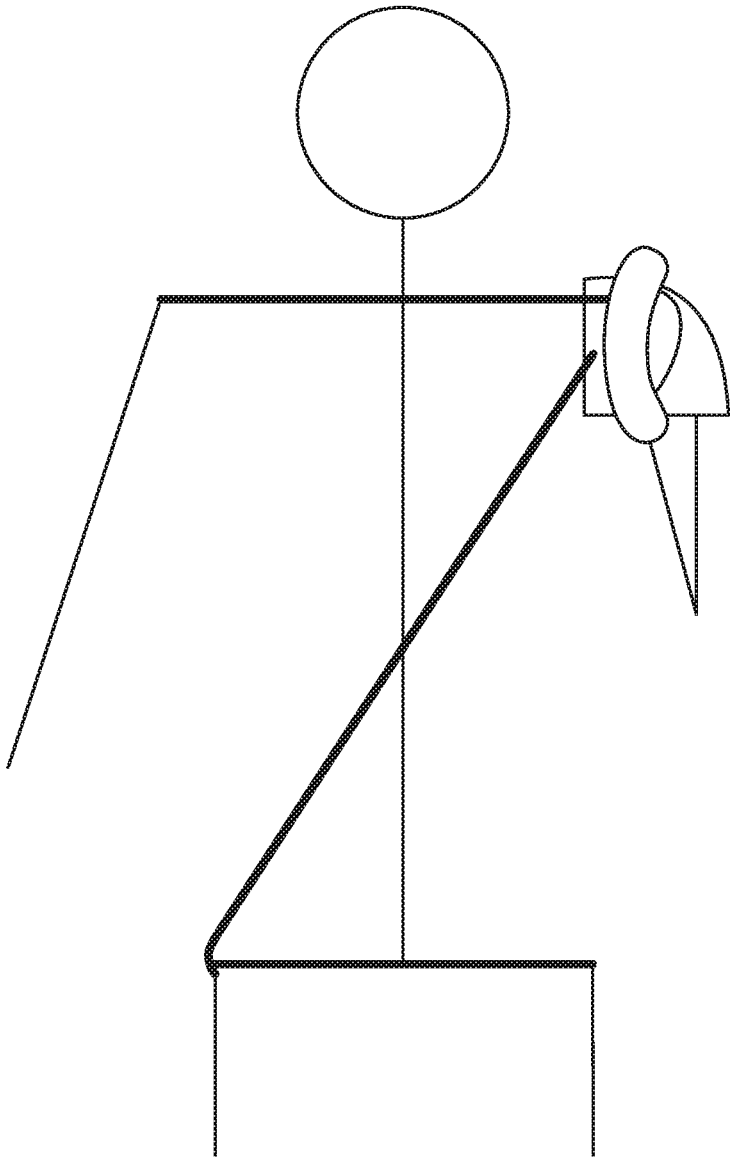
FIGS. 6-13 are diagrammatic views of a user using the device of FIG. 1.
Figure 7:
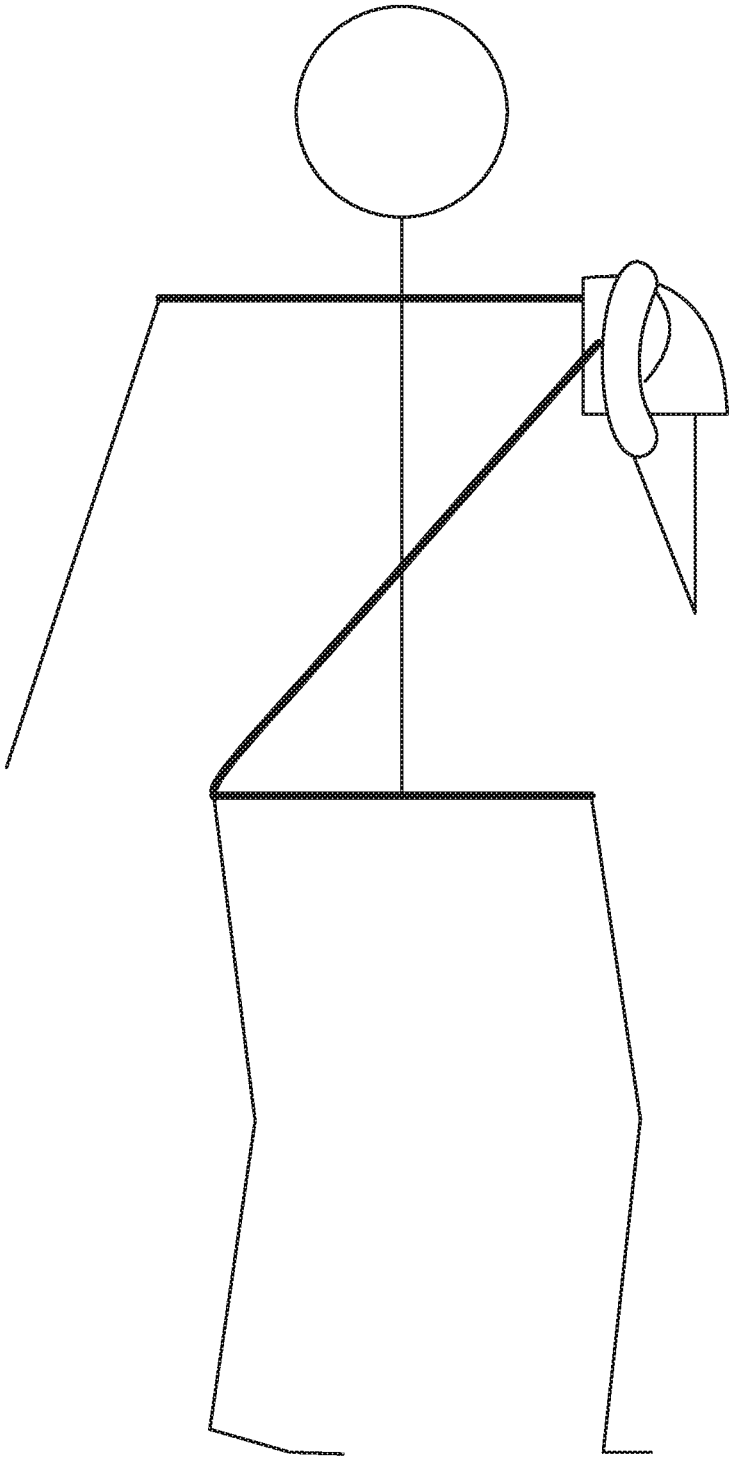
Figure 8:
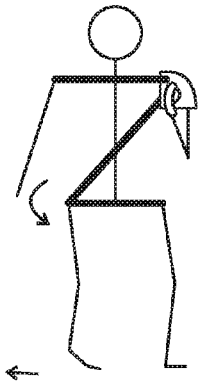
Figure 9:
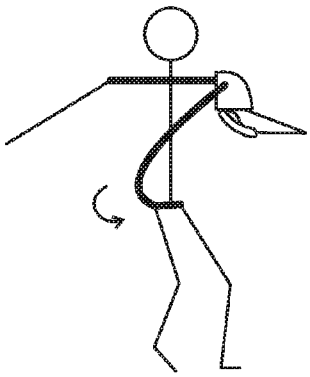
Figure 10:
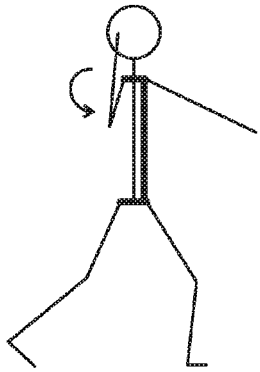
Figure 11:
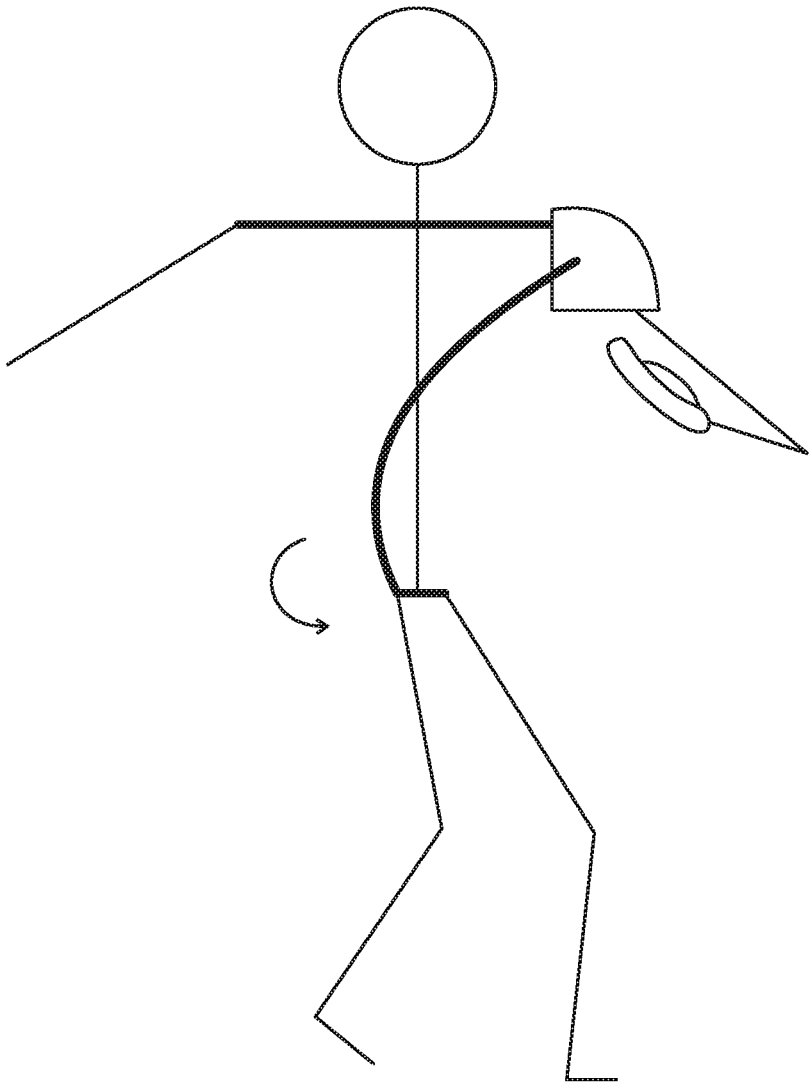

Usage:

1. The user places the glove over front of shoulder cap 01 as shown in FIG. 6.
2. The user stands in normal throwing stance with both legs slightly bent and with both feet at about 45% angle forward of body as shown in FIG. 7. The user stands slightly up on the toes of back foot to aid in pushing off.
3. The user pushes off with the back foot against the back foot toes so as to drive the hip having the opposite hip belt anchor 02 towards the throwing direction as shown in FIG. 8. If done correctly this will cause the user's hips to rotate and then slightly later pull the shoulder and throwing arm around during the throwing motion. During this step the user should make sure the hip rotation begins first as shown in FIG. 9 and then a little later in turn this hip rotation causes the shoulders to rotate as shown in FIG. 10. If done correctly, there will be a definite lag of time between when the hips rotate and when the shoulders rotate by being pulled around by the hip rotation.
4. Very importantly, if done correctly, during the beginning of the throw, the hip rotation visual indicator 03 will bow out or slacken as shown in FIG. 11. The extent to which the hip rotation visual indicator bows or slackens indicates how well the user is accomplishing the proper throwing mechanics. This is often more easily observed by another person, such as a parent, friend, teammate or coach, watching for the bowing or slackening of the hip rotation visual indicator. If the hip rotation visual indicator does not bow or slacken, does so only minimally, or worse actually stretches, the user is making one or both of the following errors:

Either: 1) The user is not driving the hip having the opposite hip belt anchor 02 toward the throwing direction so that early in the motion the hips are rotating sooner than the rotation of the shoulders; 2) The user is "opening up" the front shoulder too soon and again not allowing the hips to rotate sooner than the shoulder; or 3) The user is committing both errors.

Figure 12:
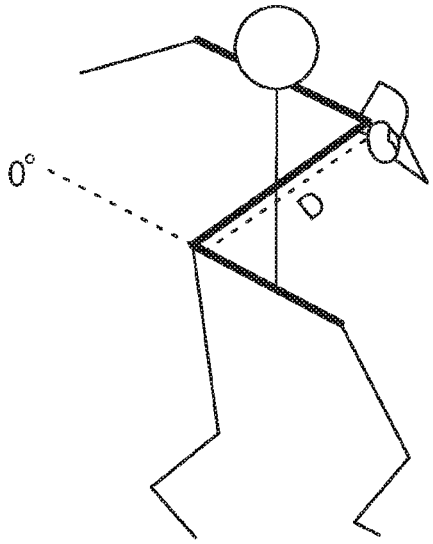

Referring now to FIGS. 12 and 13 which are perspective views of the same motion depicted by FIGS. 8 and 9. Professional pitchers world leading angle A is approximately 90 degrees. At this angle, distance D' is approximately 92% of that of distance D, but more importantly the distance B is a bow distance of approximately 16.5% of distance D. For a 6' tall male with average body structure this equals a bowed distance of approximately 4.5". This amount of bow in the Hip Rotation Visual Indicator 03 is easily recognizable by the eyes of a normal human observer. Even at an angle for A of 45 degrees, which is a poor level of throwing or swinging hip rotation, the bow, B, in the Hip Rotation Visual Indicator for a 6' tall male with average body structure is approximately 2.5" and is clearly seen by the normal human observer. In addition the distance D' is approximately 97% of distance D. A solid level of hip rotation performance ranges between 70 and 75 degrees which translates into a bow distance, B, of approximately 4" for a 6' tall male with average body structure, and the distance D' is approximately 93-94% of distance D.

Note: after practicing with enough iteration it is clear you are rotating correctly and feel or realize the difference, graduate to using this training aid as part of a normal throwing motion. Make sure this training aid continues to indicate you are properly rotating your hips in relation to the shoulders. After mastering this, if you are a pitcher, next graduate to incorporating this training aid into your normal pitching regimen.

While the preferred embodiments of the invention have been disclosed, modifications can be made and other embodiments may be devised without departing from the spirit of the invention and the scope of the appended claims.

The invention claimed is:

1. A sport training device wearable by a human user, said device comprises:

a shoulder harness;

a hip harness;

an oblong resilient, flexible member having an uncompressed and untensioned linear first length, and opposite first and second ends;

said first end being attached to a first location on said shoulder harness;

said second end being attached to a first position on said hip harness;

said first location being proximal to a first non-throwing one of said user's shoulders;

said first position being proximal to a first one of said user's hips;

wherein said first one of said user's hips is on an opposite side of the body than said first non-throwing one of said user's shoulders;

wherein said first length is selected so that said member is resiliently extended under tension when said users hips are parallel with said users shoulders; and, wherein said first length is selected so that said member is unextended when said user's hips and shoulders are angularly separated away from parallel by a first non-zero angle;

which further comprises:

an oblong, substantially non-resilient, flexible back strap having an uncompressed and untensioned linear second length, and opposite first and second terminuses;

said first terminus being attached to a second location on said shoulder harness;

said second terminus being attached to a second position on said hip harness;

said second location being proximal to said first non-throwing one of said user's shoulders; and, said second position being proximal to said first one of said user's hips on an opposite side of the user's body from said non-throwing shoulder.

2. The device of claim 1, wherein said first location is adjustable.

3. The device of claim 1, wherein said first position is adjustable.

4. The device of claim 1, wherein said member deflects uniformly under a compression load.

5. The device of claim 4, wherein the unextended condition of said member is measurable as an indicator of said first non-zero angle.

6. The device of claim 1, where said member comprises an amount of material selected from the group consisting of surgical tubing and shock cord.

7. The device of claim 1, where said member comprises a tension coil spring wherein the windings contact one another while the spring is at rest.

8. A method for training a user in an arm swinging sport, said method comprises:

fitting a shoulder harness and a hip harness onto a user;

attaching a first oblong resilient member between a non-throwing shoulder of said user and an opposite, throwing side hip of said user;

adjusting said member so that it provides a tensioning load to said harnesses when said user's shoulders and hips are substantially parallel, and provides a no tensioning load when said user's hips are twisted beyond a first angle with respect to said shoulders; and wherein said attaching a first oblong resilient member comprises running said first oblong resilient member diagonally across the front of the user's torso; and the method further comprises attaching a second oblong non-resilient member between a non-throwing shoulder of said user and an opposite, throwing side hip of said user diagonally across said user's back.

9. The method of claim 8, which further comprises initiating in said user an arm swinging sporting motion using said throwing arm.

* * * * *